US007070652B2

(12) United States Patent
Duwendag et al.

(10) Patent No.: US 7,070,652 B2
(45) Date of Patent: Jul. 4, 2006

(54) PASTE UNIT FOR A BOTTOM GUIDE DEVICE

(75) Inventors: Ruediger Duwendag, Lengerich (DE); Guido Kerres, Muenster (DE); Andrees Erdmann, Osnabrueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/721,068

(22) Filed: Nov. 26, 2003

(65) Prior Publication Data

US 2004/0103992 A1 Jun. 3, 2004

(30) Foreign Application Priority Data

Nov. 27, 2002 (DE) ..... 102 55 485

(51) Int. Cl.
*B05C 1/08* (2006.01)

(52) U.S. Cl. ..... 118/244; 118/261; 118/262; 118/304; 156/578

(58) Field of Classification Search ..... 118/244, 118/261, 262, 304; 427/428, 207.1, 428.15; 156/578

See application file for complete search history.

(56) References Cited

U.S. PATENT DOCUMENTS 5,667,589 A * 9/1997 Mailander ..... 118/261
5,961,721 A 10/1999 Feldkamper et al.
5,972,167 A * 10/1999 Hayasaka et al. ..... 162/135

FOREIGN PATENT DOCUMENTS

DE 1 123 549 2/1962
DE 196 34 594 3/1998
DE 101 22 573 11/2002

* cited by examiner

*Primary Examiner*—Laura Edwards
(74) *Attorney, Agent, or Firm*—Jacobson Holman PLLC

(57) ABSTRACT

A paste unit for a bottom guide device for gluing bottom warps or star seal bottom bags, which are formed of tube sections, is introduced. The paste unit includes an interchangeable glue reservoir and glue source nozzle, a metering roller, a glue application roller, as well as a making roller. Drive mechanisms are assigned to the rollers. The glue is transferred to the printing roller by the glue application roller. The paste unit may be operated with the glue reservoir to provide a closed system that allows the glue to be applied evenly, and the metering to be adjusted at a very fine setting. Alternatively, with the glue source nozzle installed, the paste unit functions as an open system, which is beneficial for use with certain types of glue.

17 Claims, 3 Drawing Sheets

PASTE UNIT FOR A BOTTOM GUIDE DEVICE

BACKGROUND OF THE INVENTION

1. Field of the Invention

The invention relates to a paste unit for a bottom buide device for star seal bottom bags having a glue reservoir or clue source, a metering roller in contact with the clue reservoir or glue source, a glue application roller which may be in contact with the glue reservoir or glue source, a making roller in contact with the glue application roller for transferring glue from the application roller to the bottom warps or the star seal bottoms, and drive mechanisms assigned to the above mentioned rollers.

2. Description of the Related Art

In a paste unit of a bottom guide device, glue is applied to the reared end, or the reared ends, and the thereby formed corner wraps of a tube section made of paper, plastic, or another suitable material, in order to subsequently achieve a permanently glued bag bottom by means of placing the reared ends onto the corner wraps.

A typically utilized paste unit of a bottom guide device is, for example, illustrated in patent specification DE 196 34 594 O2. A metering roller and a glue application roller are supported in a base plate, which together form a closed system in a body, in which a glue column of desired height is held. The glue is transferred to the printing roller from the glue application roller, whereas the amount of glue to be transferred is adjusted by the suitable selection of the distance between the metering roller and the glue applicatin roller. The printing roller transfers the glue to the workpiece to be glued. The closed system offers the advantage that the glue is applied evenly, and that the metering can be adjusted in very sensitive settings. Furthermore, no glue can be spread to the environment of the paste unit, which would cause contamination, as well as unnecessary glue consumption.

An open system is used in other known paste units. Principally, they are the same paste units as previously described, but instead of a body serving as the glue reservoir, a nozzle is merely used as the glue source. This nozzle is attached on the side of the gap between the metering roller and the glue application roller opposite of the printing roller. In such a paste unit, the rollers must be arranged vertically, whereas the nozzle applies the glue at the upper end of the metering roller on its exterior circumference. By means of gravitation and the rotation of the metering roller, the glue is distributed across the entire surface. The glue is fed from the metering roller across the glue application roller, and the printing roller is fed to the workpiece. The open system is said to have benefits with the use of certain types of glue. Due to the short duration of the glue in an open system—the use of this system leads to high losses of glue—the same can supply only a small amount of a solvent, and is therefore not prone to drying on.

SUMMARY OF THE INVENTION

The task of the invention is therefore to provide a device, which combines the benefits of both pasting devices, and can be provided at a low cost.

According to the invention, this task is solved by a paste unit having a glue reservoir or glue source, a metering roller in contact with the glue reservoir or glue source, a glue application roller which may be in contact the glue reservoir or glue source, a making roller in contact with the clue application roller for transferring glue from the application roller to the bottom warps or the star seal bottoms, and drive mechanisms assigned to the above listed rollers, in which the paste unit can be operated in an operating mode as either an open or a closed glue application system.

Accordingly, the metering roller can at least sequentially be connected to a glue source, as well as to a glue reservoir. In such a paste unit, nearly all glue types can be processed, which are used for the production of star seal bottom bags. Suitable glue types can be retained in the glue reservoir, whereas such glue types, which do not allow processing from a glue reservoir, are applied to the metering roller by means of a nozzle.

It is especially advantageous, if the direction of rotation of the metering roller can be reversed. In a closed system, the metering roller usually has the same direction of rotation as the glue application roller in order to prevent an unintentional discharge of glue from the reservoir. In an open system, however, the metering roller should have an opposite direction of rotation in relation to the glue application roller for the purpose of an optimal glue transfer.

At least one of the previously mentioned rollers advantageously has its own drive motor for the simple reversal of the direction of rotation.

It is also advantageous that at least one of the previously mentioned rollers has its own electric motor, which is supplied with current by means of a power electronic power source.

In an especially advantageous embodiment of the invention, this roller is the metering roller.

Additional embodiment examples of the invention are found in the objective description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
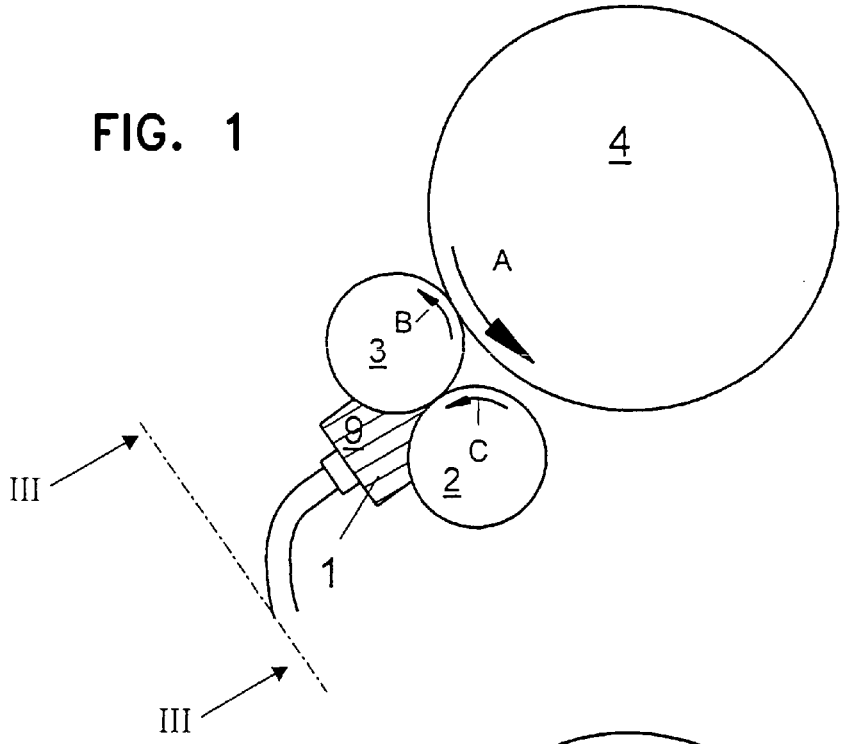
FIG. 1 Top view of a closed paste unit

FIG. 1 shows a paste unit of a bottom guide device with a closed glue application system.

The glue 9 is located in the glue reservoir 1. The glue reservoir, as well as the rollers 2, 3, and 4, are attached to a base plate, which is not illustrated. The side walls of the glue reservoir 9 are in contact with the metering roller 2 and the glue application roller 3 so that no glue may escape at these contact ends. The glue 9 is carried by the glue application roller 3, and can pass the adjustable gap between the metering roller 2 and the glue application roller 3. The directions of rotation B and C of the metering roller 2 and the glue application roller 3 are the same. The direction of rotation C shown prevents the metering roller 2 from also transporting glue 9 from the glue reservoir 1. Additional details regarding the storage of rollers 2, 3, and the attachment of the glue reservoir 1 are described in patent specification DE 196 34 594 C2.

Figure 2:
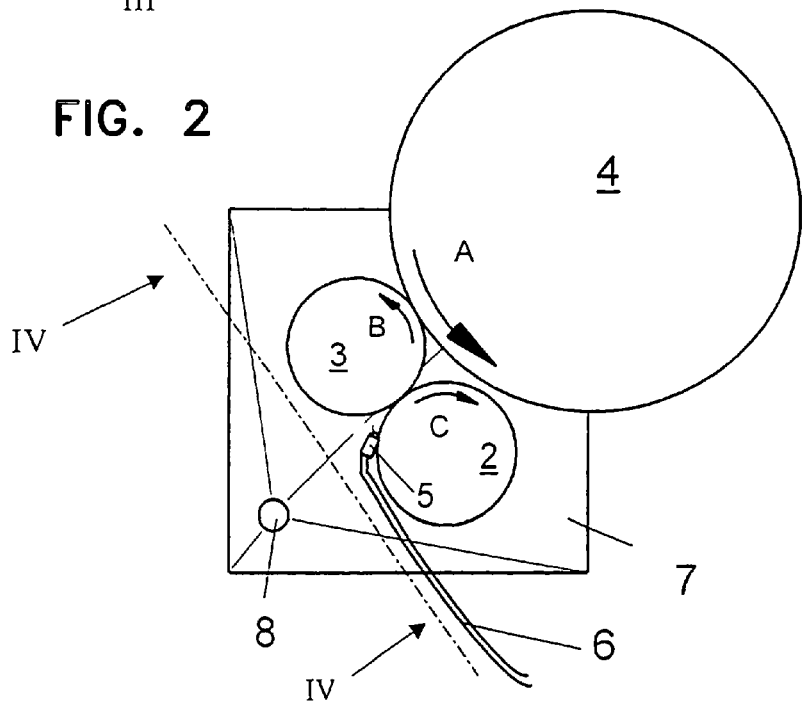
FIG. 2 Top view of an open paste unit

FIG. 2 shows the same paste unit in an operating mode as an open glue application system. In order to prepare the paste unit for this operating method, the glue reservoir 1 is disassembled, and a glue nozzle 5 is attached on the base plate, which is not illustrated. In order to operate the open paste unit, the glue application roller 3 and the printing roller 4 maintain their direction of rotation. The direction of rotation of the metering roller is reversed with regard to the closed operating mode. The glue is fed to the glue nozzle 5 via a feed line 6, which is arranged at the upper end of the metering roller 2. The glue nozzle 5 applies the glue onto the metering roller. The glue is transferred to the glue application roller 3, and subsequently reaches the printing roller, which transfers the glue to the workpiece to be glued. A glue pan 7 is arranged below the metering roller 2 and the printing roller 3, which catches the glue dripping from and catapulted by the rollers, and discharges it via a drain 8.

Figure 3:
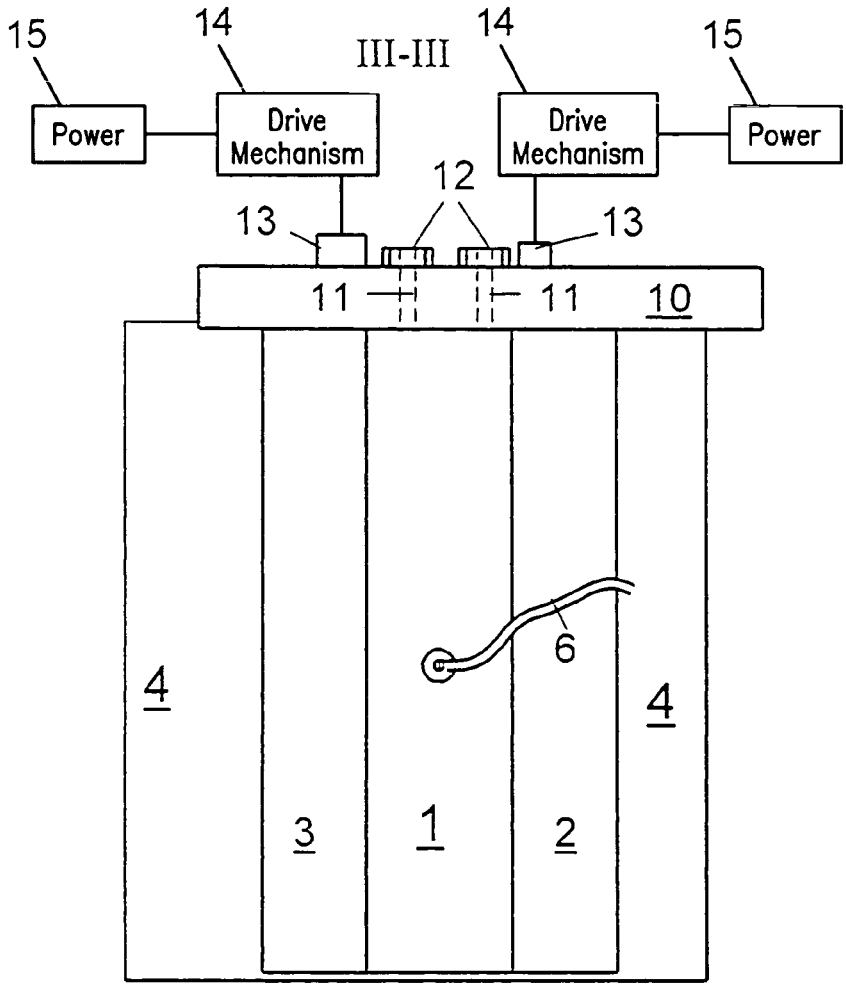
FIG. 3 Side view according to section III—III in FIG. 1

FIG. 3 shows a closed paste unit according to section III—III in FIG. 1. The rollers 2, 3 form one end with their roller axes 13, and are pivoted in the base plate 10. The base plate is not connected to the machine rack in a more detailed manner. The roller axes 13 can be driven by drive mechanisms 14 with attached drives, such as toothed belt disks, on which a toothed belt is carried. The drive mechanisms 14 are supplied with current by means of a power source 15, such as a frequency converter. Two bolts 11 are firmly attached to the glue reservoir, which can be inserted through two through bores in the base plate 10. Above the base plate, the bolts, which have a thread at least at their upper ends, are secured with nuts 12, such as knurled nuts. In this way, the glue reservoir 1 can easily be attached to the base plate 10, or removed from the same.

Figure 4:
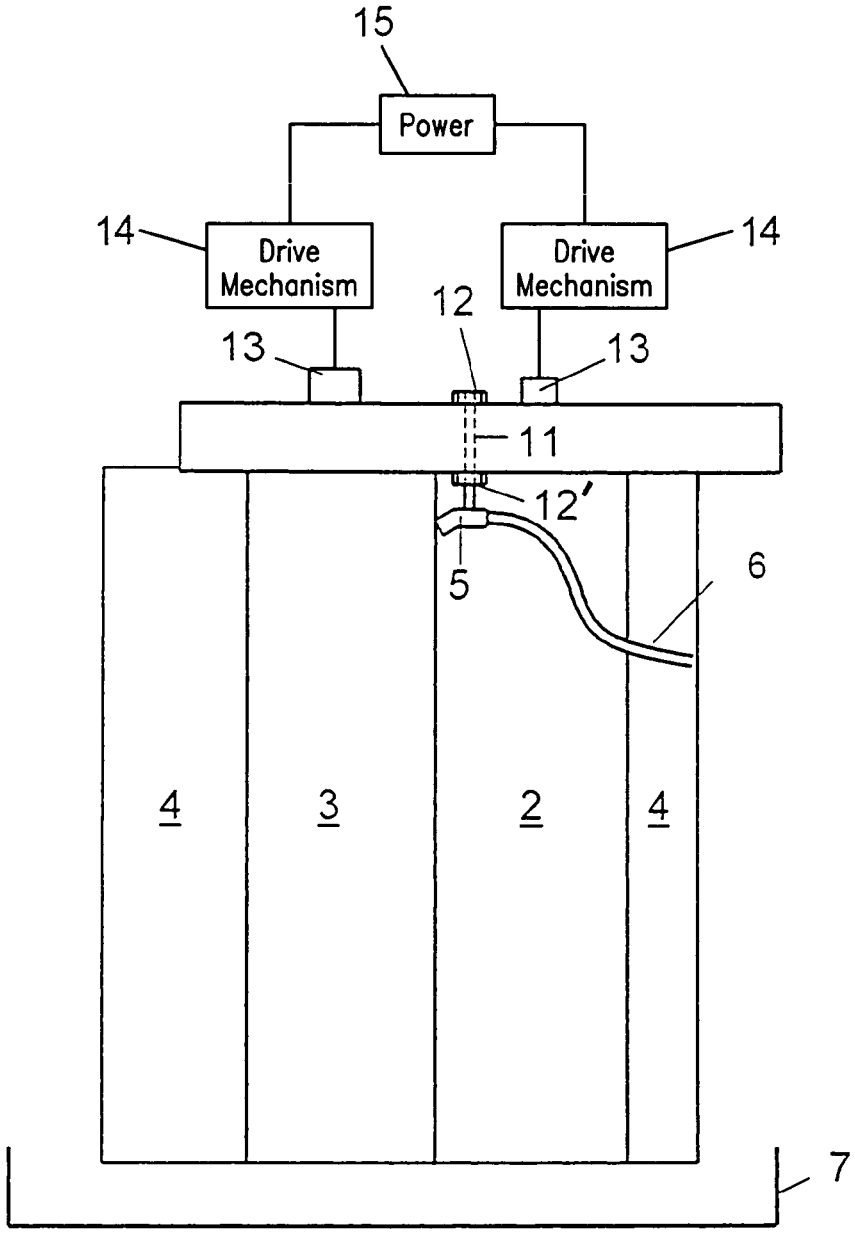
FIG. 4 Side view according to section IV—IV in FIG. 2

FIG. 4 shows an open paste unit according to section IV—IV in FIG. 2. After removing the glue reservoir 1, a bolt 11 can be inserted through one of the through bores in the base plate 10, on which the glue nozzle 5 is attached. The bolt 11 is secured from falling out by means of a nut 12, which is screwed onto the bolt 11 above the base plate. An additional nut 12' can be screwed onto the bolt 11 below the base plate 10 for the purpose of height adjustment. As shown, the drive mechanisms 14 may be powered by a common power source 15.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| Reference Symbol List | |
|---|---|
| 1 | Glue reservoir |
| 2 | Metering roller |
| 3 | Glue application roller |
| 4 | Printing roller |
| 5 | Glue nozzle/source |
| 6 | Feed line |
| 7 | Glue pan |
| 8 | Drain |
| 9 | Glue |
| 10 | Base plate |
| 11 | Bolt |
| 12 | Nut |
| 13 | Roller axis |

-continued

| Reference Symbol List | |
|---|---|
| A | Direction of rotation of the printing roller 4 |
| B | Direction of rotation of the glue application roller 3 |
| C | Direction of rotation of the glue application roller 2 |

The invention claimed is:

1. A paste unit for a bottom guide device for gluing of bottom warps or star seal bottom bags, comprising:

a glue element;

a metering roller in contact with said glue element;

a glue application roller adjacent the metering roller;

a making roller in contact with the glue application roller which transfers glue from said glue application roller to the bottom warps or the star seal bottoms; and drive mechanisms assigned to said rollers;

said glue element being one of a removable glue reservoir or a removable glue source nozzle, said reservoir and said nozzle being interchangeable such that said metering roller is sequentially connectable thereto for operation of said bottom guide device as either a closed system with said glue reservoir in place or as an open system with said glue source nozzle in place.

2. The paste unit according to claim 1, wherein a direction of rotation of the metering roller can be reversed.

3. The paste unit according to claim 1, wherein said glue application roller has its own drive mechanism.

4. The paste unit according to claim 3, wherein said clue application roller drive mechanism is supplied with current by a power source.

5. The paste unit according to claim 1, wherein said metering roller has its own drive mechanism.

6. The paste unit according to claim 5, wherein said metering roller drive mechanism is supplied with current by a power source.

7. The paste unit according to claim 1, wherein when said glue reservoir is connected to said metering roller, said metering roller and said glue application roller have a same direction of rotation and the glue is carried from said reservoir by said glue application roller.

8. The paste unit according to claim 1, wherein when said glue source nozzle is connected to said metering roller, said metering roller and said glue application roller have opposite directions of rotation and said glue source nozzle applies the glue to said metering roller which transfers said glue to said glue application roller.

9. The paste unit according to claim 1, wherein said glue application roller and said metering roller are mounted in a base plate having a through bore therein, said glue reservoir and said glue source nozzle being alternately coupled to said base plate by a bolt passing through said through bore.

10. The paste unit according to claim 1, wherein said making roller has its own drive mechanism.

11. The paste unit according to claim 10, wherein said making roller drive mechanism is supplied with current by a power source.

12. A paste unit for a bottom guide device for gluing of bottom warps or star seal bottom bags, said paste unit operable as either an open glue application system or a closed glue application system, comprising:

a metering roller and a glue application roller mounted adjacent to one another in a base plate;

a making roller in contact with the glue application roller which transfers glue from said glue application roller to the bottom warps or the star seal bottoms;

a coupling element in said base plate positioned proximate to an interface between said metering roller and said glue application roller;

a first glue element removably coupled to said coupling element for operation of said paste unit as an open glue application system; and a second glue element removably coupled to said coupling element for operation of said paste unit as a closed glue application system, only one of said first and second glue elements being coupled to said coupling element at any one time.

13. The paste unit according to claim 12, wherein said first glue element is a glue nozzle.

14. The paste unit according to claim 13, wherein a direction of rotation of the metering roller can be reversed, said metering roller and said glue application roller having opposite directions of rotation and said glue nozzle applying the glue to said metering roller when said glue nozzle is connected to said coupling element, said metering roller transferring said glue to said glue application roller.

15. The paste unit according to claim 12, wherein said second glue element is a glue reservoir.

16. The paste unit according to claim 15, wherein a direction of rotation of the metering roller can be reversed, said metering roller and said glue application roller having a same direction of rotation and the glue being carried from said reservoir by said glue application roller when said glue reservoir is connected to said coupling element.

17. The paste unit according to claim 12, wherein said coupling element includes a through bore with a fastener passing therethrough.

* * * * *